United States Patent [19]

Lane, III

[11] 4,370,018

[45] Jan. 25, 1983

[54] UNIVERSAL TERMINAL BLOCK CONNECTOR

[75] Inventor: Charles E. Lane, III, Meadowbrook, Pa.

[73] Assignee: Honeywell Inc., Minneapolis, Minn.

[21] Appl. No.: 206,612

[22] Filed: Nov. 13, 1980

[51] Int. Cl.[3] ..... H01R 9/10

[52] U.S. Cl. ..... 339/263 R

[58] Field of Search ..... 339/263; 411/166, 427, 411/432, 433

[56] References Cited

U.S. PATENT DOCUMENTS 3,414,866 12/1968 Norden ..... 339/263 R

FOREIGN PATENT DOCUMENTS 736096 6/1966 Canada ..... 339/263 R

*Primary Examiner*—Joseph H. McGlynn

*Attorney, Agent, or Firm*—Laurence J. Marhoefer; Lockwood D. Burton; Mitchell J. Halista

[57] ABSTRACT

A terminal block connector uses a first nut having an internal thread of a first diameter and type and a second nut coaxially arranged therewith having an internal thread of a second diameter and type. To further the universality of the connector, the first thread may be an SAE thread while the second thread may be a metric thread, while the first diameter is always smaller than the second diameter. The first nut is arranged to cooperate with a first diameter machine screw while the second nut is arranged to cooperate with a second diameter machine screw. The two nuts are held rotationally captive in a coaxial recess in an electrically insulating block with the larger thread diameter second nut located at the entrance to the recess. The smaller thread diameter first nut is initially positioned beneath the large diameter second nut and in frictional engagement with the wall of the recess with a space between the first nut and the bottom of the recess. In an alternate embodiment, the recess is substantially longer than the combined thickness of the two nuts, and a spring is located between the internal end of the recess and the inner one of the two nuts to urge the nuts together and against the recess entrance and to permit a separation of the two nuts by a machine screw engaging the second diameter nut while projecting therefrom into the recess.

10 Claims, 4 Drawing Figures

UNIVERSAL TERMINAL BLOCK CONNECTOR

BACKGROUND OF THE INVENTION

Field Of The Invention

The present invention relates to connectors. More specifically, the present invention is directed to a connector for an electrical terminal block.

SUMMARY OF THE INVENTION

The object of the present invention is to provide an improved electrical terminal block connector.

In accomplishing this and other objects, there has been provided, in accordance with the present invention, a terminal block connector having a first and a second nut with the first nut having a first diameter thread and the second nut having a second diameter thread smaller than the first diameter thread. The two nuts are coaxially arranged and are held captive in a coaxial recess with the large diameter nut being positioned at the entrance to the recess.

BRIEF DESCRIPTION OF THE DRAWINGS

A better understanding of the present invention may be had when the following detailed description is read in connection with the accompanying drawings, in which.

DESCRIPTION OF THE PREFERRED EMBODIMENT

Figure 1:
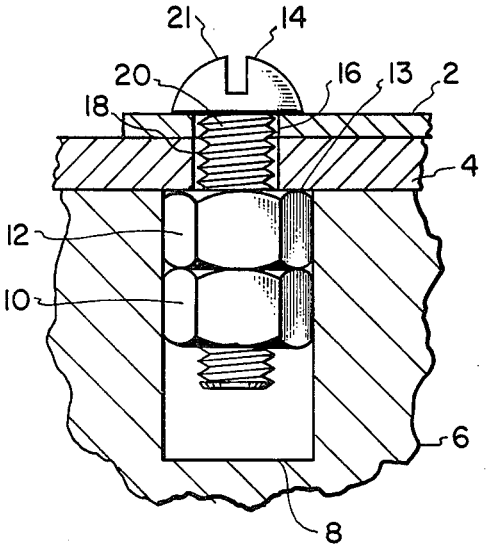
FIG. 1 is a cross-sectional illustration of a terminal block embodying an example of the present invention.

Referring to FIG. 1 in more detail, there is shown a cross-sectional illustration of an example of the present invention used for connecting an electrical lead 2 to an electrically conductive plate 4, e.g., a portion of a so-called barrier strip or terminal block. The electrically conductive plate 4 is attached to an insulating substrate by any suitable means (not shown). The substrate 6 has a recess 8 therein which is arranged to rotationally captivate a first nut 10 and a second nut 12 therein. The first and the second nuts 10, 12 are arranged coaxially with each other and with an entrance 13 to the recess 8. The depth of the recess 8 is greater than the combined thickness of the nuts 10, 12 to allow the first, or inner, nut 10 to move away from the second, or outer, nut 12. However, the recess 8 is arranged to frictionally engage the first nut 10 to initially retain it against the second nut 12. The recess 8 may also be proportioned to frictionally engage the second nut 12 to maintain it at the entrance of the recess 8 after the first nut 10 has been displaced toward the bottom of the recess 8. A machine screw 14 is positioned to pass through a hole 16 in the electrical lead 2, a hole 18 in the plate 4 and the entrance 13 of the recess 8. Specifically, the threaded shank 20 of the machine screw 14 is arranged to enter the recess 8 to engage either one of the nuts 10, 12 held in the recess 8. Concurrently, the head 21 of the machine screw 14 is effective to urge the lead 2 against the plate 4 to secure the lead 2 to the plate 4.

Figure 2:
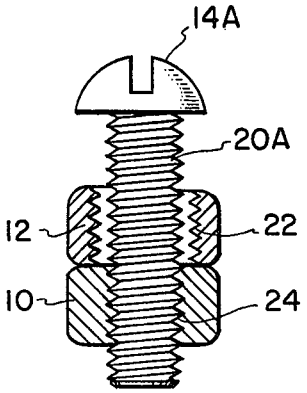
FIG. 2 is a cross-sectional illustration showing the operation of the example of the present invention shown in FIG. 1 with a first diameter machine screw.

In FIG. 2, there is shown a cross-sectional illustration of the operation of the example of the present invention shown in FIG. 1 with a machine screw 14A having a first diameter threaded shank 20A. The second nut 12 is arranged to have an internally threaded second diameter 22 which is larger than the internally threaded first diameter 24 of the first nut 10. The coaxial orientation of the first and the second nuts 10, 12 allows the threaded shank 20A of the machine screw 14A to pass through the larger thread diameter 22 of the second nut 12 and to engage the smaller thread diameter 24 of the first nut 10.

Figure 3:
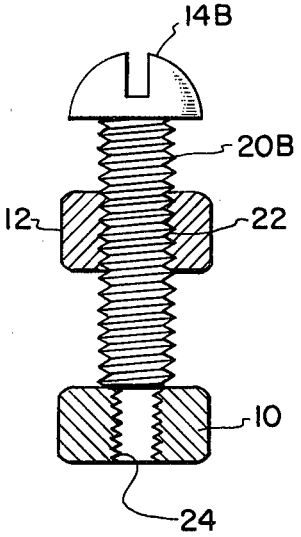

In FIG. 3, there is shown a cross-sectional illustration of the operation of the example of the present invention shown in FIG. 1 using a machine screw 14B having a second diameter shank 20B. In this operation, the larger threaded shank 20B of the machine screw 14B would engage the larger second diameter of the second nut 12 and would be unable to enter the internally threaded first diameter 24 of the first nut 10. In this embodiment, the entire length of the shank 20B of the machine screw 14B shown in FIG. 3 is accommodated by allowing the end of the shank 20B projecting past the second nut 12 to displace the first nut 10 toward the bottom of the recess 8 since the recess 8 has a depth greater than the combined thickness of the nuts 10, 12. In both of these operations as shown in FIGS. 2 and 3, the engaging of the threaded shank 20 of the machine screw 14 with one of the nuts 10, 12 would enable the lead 2 to be securely attached to the metal plate 4 while accommodating a substantial variation in the thickness of the lead 2. The machine screw 14 and the nuts 10, 12 are preferably made from metal although electrically insulating materials, e.g., plastics, could be used therefor.

Figure 4:
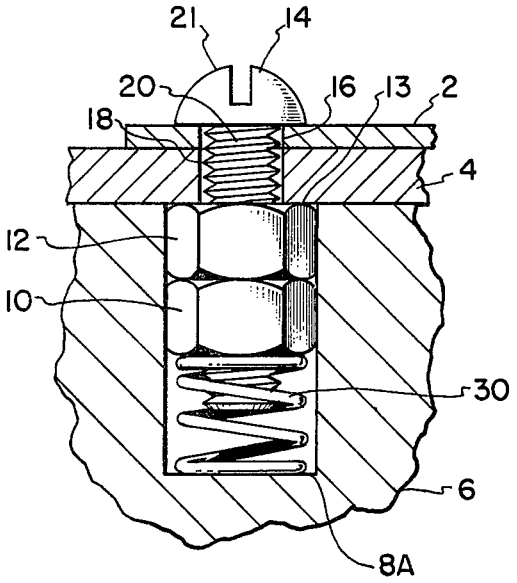
FIG. 3 is a cross-sectional illustration showing the operation of the example of the present invention shown in FIG. 1 with a second diameter machine screw and FIG. 4 is a cross-sectional illustration of a second example of an embodiment of the present invention.

In FIG. 4, there is shown a second example of an embodiment of the present invention wherein the recess 8A has a greater depth than the recess 8 shown in FIG. 1 and the first nut 10 has a substantially free sliding fit in the recess 8A. The first and second nuts 10 and 12 are positioned in the recess 8A and are held against the metal plate 4 by a spring 30 located within the recess between the first nut 10 and the bottom of the recess 8A. Thus, the expanded length of the spring 30 is effective to maintain the nuts 10, 12 at the entrance end 13 of the recess 8A. In this embodiment, the entire length of the shank 20B of the machine screw 14B shown in FIG. 3 is accommodated by allowing the end of the shank 20B projecting past the second nut 12 to displace the first nut 10 toward the bottom of the recess 8 against the pressure of the spring 30 since the recess 8 has a depth greater than the combined thickness of the nuts 10, 12 and the compressed length of the spring 30. Conversely, a screw shank 20A shown in FIG. 2 would engage the first nut 10 without a displacement of the first nut 10 against the pressure of the spring 30. In other words, the engagement of the lower or first nut 10 is achieved by a screw shank 20A passing through the upper nut 12 while the same length of the shank 20B which would engage the upper or second nut 12 would also project out of the second nut 12 and would simply displace the lower nut 10 against the pressure of the spring 30 as the end of the shank 20B emerged from the adjacent face of the upper nut 12. Upon a withdrawal of the machine screw 14 from a position engaging the nuts 10, 12, the spring 30 would restore the nuts 10, 12 to their stacked position at the entrance of the recess 8A for subsequent use. In either example of the present invention as shown in FIGS. 1 and 4, the nuts 10 and 12 can have either the same type of thread, e.g., SAE, or different types of threads, e.g., SAE and metric, to further enhance the universality of the present invention.

Accordingly, it may be seen, that there has been provided, an improved electrical terminal block connector.

The embodiments of the invention in which an exclusive property or privilege is claimed are defined as follows:

1. A terminal block connector comprising:

a first nut having a first thread diameter, a second nut having a second thread diameter larger than said first thread diameter, a support block and a recess in said block rotationally capturing said first nut and said second nut therein in a mutually coaxial relationship with each other and with said recess, said first nut being freely axially separable from said second nut within said recess, and with said second nut being positioned at an entrance to said recess and said first nut being located subsequent to said second nut in said recess with respect to the entrance to said recess.

2. A connector as set forth in claim 1 and further including an electrically conductive plate located on said support block and having a hole through said plate and coaxially with the entrance to said recess to accommodate a threaded member entering said recess.

3. A connector as set forth in claim 1 wherein said first nut has a different type of thread from the thread of said second nut.

4. A connector as set forth in claim 3 wherein the one thread type is SAE and the other thread type is metric.

5. A connector as set forth in claim 1 and including a spring located in said recess between said first nut and an end of said recess to urge said first and second nuts toward the entrance to said recess.

6. A connector as set forth in claim 5 wherein said first nut has a substantially free sliding fit in said recess.

7. A connector as set forth in claim 5 wherein said first nut has a different type of thread from the thread of said second nut.

8. A connector as set forth in claim 7 wherein the one thread type is SAE and the other thread type is metric.

9. A connector as set forth in claim 1 wherein said recess has a depth greater than the combined thickness of said first and second nuts and wherein said first nut has a frictional sliding fit with the wall of said recess.

10. A connector as set forth in claim 9 wherein said first and second nuts are initially in contact within said recess.

* * * * *